US006943765B2

(12) United States Patent
Aoki

(10) Patent No.: US 6,943,765 B2
(45) Date of Patent: Sep. 13, 2005

(54) ELECTRO-OPTICAL-DEVICE DRIVING METHOD, IMAGE PROCESSING CIRCUIT, ELECTRONIC APPARATUS, AND CORRECTION-DATA GENERATING METHOD

(75) Inventor: Toru Aoki, Shiojiri (JP)

(73) Assignee: Seiko Epson Corp., Tokyo (JP)

( * ) Notice: Subject to any disclaimer, the term of this patent is extended or adjusted under 35 U.S.C. 154(b) by 384 days.

(21) Appl. No.: 10/180,339

(22) Filed: Jun. 27, 2002

(65) Prior Publication Data

US 2003/0011585 A1 Jan. 16, 2003

(30) Foreign Application Priority Data

Jul. 9, 2001 (JP) ..... 2001-208476
May 14, 2002 (JP) ..... 2002-139085

(51) Int. Cl.[7] ..... G09G 3/36
(52) U.S. Cl. ..... 345/94; 345/213; 345/98
(58) Field of Search ..... 345/87, 88, 89, 345/94, 98, 99, 100, 204, 92, 213; 348/744, 751

(56) References Cited

U.S. PATENT DOCUMENTS 4,230,408 A * 10/1980 Nigg ..... 355/35
5,594,736 A * 1/1997 Tatsumi et al. ..... 370/474
5,838,396 A * 11/1998 Shiota et al. ..... 348/745
5,973,661 A * 10/1999 Kobayashi et al. ..... 345/100
6,011,533 A * 1/2000 Aoki ..... 345/92
6,462,735 B2 * 10/2002 Naito ..... 345/204
6,570,611 B1 * 5/2003 Satou et al. ..... 348/189
6,731,266 B1 5/2004 Jung

FOREIGN PATENT DOCUMENTS

| | | |
|---|---|---|
| JP | A-5-27701 | 2/1993 |
| JP | A-8-223519 | 8/1996 |
| JP | A-11-133932 | 5/1999 |
| KR | 2000-0018581 | 6/2000 |

* cited by examiner

*Primary Examiner*—Kent Chang
(74) *Attorney, Agent, or Firm*—Oliff & Berridge, PLC

(57) ABSTRACT

Correction tables store correction data. Based on the correction data, a linear interpolation circuit generates data in accordance with a data value of input image data. A latch circuit group latches each piece of output data of the linear interpolation circuit in synchronization with a rising edge of a block signal. A selector selects correction data based on an address signal and outputs the correction data to an adder circuit. The adder circuit adds delayed image data to the selected correction data, thus generating corrected image data. Accordingly, an error among channels, which is caused by phase expansion, can be corrected.

12 Claims, 14 Drawing Sheets

ELECTRO-OPTICAL-DEVICE DRIVING METHOD, IMAGE PROCESSING CIRCUIT, ELECTRONIC APPARATUS, AND CORRECTION-DATA GENERATING METHOD

BACKGROUND OF THE INVENTION

1. Field of Invention

The present invention relates to electro-optical-device driving methods suitable for use in electro-optical devices, such as liquid crystal displays, image processing circuits, electronic apparatuses, and correction-data generating methods.

2. Description of Related Art

Main portions of a video projector include a light source, a liquid crystal display panel (LCD panel), and a lens. Light from the light source is displayed on a screen through the LCD panel in which the transmission factor is adjusted for each pixel in accordance with input image data and the lens. The resolution of a displayed image depends on the pixel pitch of the LCD panel. It is thus necessary to reduce the pixel pitch in order to display a high-definition image.

The LCD panel is formed by attaching a device substrate and an opposing substrate to each other with a gap defined therebetween, the gap being filled with liquid crystal. The opposing substrate has a common electrode. In contrast, the device substrate has a plurality of scanning lines, a plurality of data lines, and pixel electrodes and switching elements provided corresponding to intersections of the scanning lines and the data lines. The scanning lines are sequentially selected every horizontal period. While one scanning line is selected, a data signal is supplied to each data line and is written to a pixel electrode.

The smaller the pixel pitch becomes, the greater the number of pixels becomes. Accordingly, the number of data lines also increases. As a result, the period during which the data signal is written to the pixel electrode is shortened. Since the data lines have parasitic capacitance, the data signal cannot be sufficiently written thereto when the writing period is short.

The related art includes a technology for simultaneously selecting a plurality of data lines and for supplying an image signal to the data lines in parallel. In the following description, a plurality of data lines to be selected simultaneously is referred to as a block. For example, when one block includes six data lines, an image signal on one channel is split into six channels, and the time base of the split image signals is expanded six times. It is thus possible to ensure sufficient time for data signals to be written. As a result, a high-definition image can be displayed.

SUMMARY OF THE INVENTION

When an image signal is split into a plurality of channels, if transfer characteristics, such as gain, are not uniform among channels, the displayed image becomes uneven, depending on each block period.

The degree of display unevenness differs depending on the display gray level. This is because the ratio of the change in transmission factor to the voltage applied to the liquid crystal differs depending on the applied voltage. For example, liquid crystal used in the LCD panel is such that the transmission factor saturates at 0% when the applied voltage is 2 V; the transmission factor saturates at 100% when the applied voltage is 5 V; and the transmission factor saturates at 50% when the applied voltage is 3.5 V. In this case, the ratio of the change in transmission factor to the applied voltage is the greatest when the applied voltage is 3.5 V. When the applied voltage approaches 2 V or 5 V, the ratio becomes smaller. Even when the channels have an error of 0.1 V between one another, the degree of gray-level error perceived by the human eye differs between a case in which the target voltage is 3.5 V and a case in which the target voltage is 2.5 V.

In view of the foregoing circumstances, the present invention reduces or suppresses display unevenness in each block period and enhances the quality of a displayed image.

Thus, a driving method of the present invention can be applied to an electro-optical device including a plurality of switching elements provided corresponding to intersections of a plurality of scanning lines and a plurality of data lines, and a plurality of pixel electrodes provided corresponding to the plurality of switching elements. The driving method includes steps of: correcting an input image signal and generating a corrected image signal; splitting the corrected image signal into a plurality of channels and expanding the time base of the split image signals, whereby phase-expanded image signals, which are phase-expanded into the plurality of channels, are generated; sequentially selecting the scanning lines; and supplying, in a period during which each of the scanning lines is selected, the phase-expanded image signals corresponding to the data lines in each block, which include the plurality of data lines. In the step of generating the corrected image signal, the input image signal is corrected based on a correction signal generated based on an error in each channel, the error occurring in the step of generating the phase-expanded image signals.

According to the present invention, the input image signal is corrected based on the correction signal. Prior to splitting the input image signal into a plurality of channels, the error in each channel, which occurs in the step of generating the phase-expanded image signals, can be canceled. Thus, the quality of a displayed image can be enhanced.

A driving method of the present invention can be applied to an electro-optical device including a plurality of switching elements provided corresponding to intersections of a plurality of scanning lines and a plurality of data lines, and a plurality of pixel electrodes provided corresponding to the plurality of switching elements. The driving method includes steps of: splitting an input image signal into a plurality of channels and expanding the time base of the split image signals, whereby phase-expanded image signals, which are phase-expanded into the plurality of channels, are generated; correcting the phase-expanded image signals based on a correction signal generated based on an error in each channel, the error occurring in the step of generating the phase-expanded image signals; sequentially selecting the scanning lines; and supplying, in a period during which each of the scanning lines is selected, corrected phase-expanded image signals to the corresponding data lines in each block, which include the plurality of data lines.

According to the present invention, correction can be performed by canceling the error in each channel during phase expansion. Thus, the quality of a displayed image can be enhanced.

An image processing circuit of the present invention can be used in an electro-optical device which includes a plurality of switching elements provided corresponding to intersections of a plurality of scanning lines and a plurality of data lines, and a plurality of pixel electrodes provided corresponding to the plurality of switching elements. The electro-optical device sequentially selects the scanning lines and applies phase-expanded image signals in each block, which include the plurality of data lines, in a period during which each of the scanning lines is selected. The image processing circuit includes a correction device that generates, in synchronization with a period in which the block is selected, each correction signal to correct an error synchronized with the period in which the block is selected and to correct an input image signal based on each correction signal, whereby a corrected image signal is generated; and a generation device that splits the corrected image signal into a plurality of channels and that expands the time base of the split image signals, whereby the phase-expanded image signals, which are phase-expanded into the plurality of channels, are generated.

According to the present invention, each correction signal is generated in synchronization with the period in which the block is selected, and the input image signal is corrected based on each correction signal. Thus, the error in each channel, which occurs in the step of generating the phase-expanded image signals, can be canceled, and the quality of a displayed image can be enhanced.

Preferably, the correction device includes a latch circuit group that latches each correction signal in the period in which the block is selected; a selection circuit that sequentially selects output signals of the latch circuit group; and a combining circuit that combines an output signal of the selection circuit with the input image signal, whereby the corrected image signal is generated.

According to the present invention, after being latched, correction signals are sequentially selected to correct the input image signal.

Preferably, the correction device selects each correction signal in accordance with a direction in which the data lines are selected, and generates the corrected image signal based on the selected correction signal and the input image signal. In this case, preferably the correction device includes a latch circuit group to latch each correction signal in the period in which the block is selected; a selection circuit that sequentially selects output signals of the latch circuit group based on a control signal indicating the direction in which the data lines are selected; and a combining circuit that combines an output signal of the selection circuit with the input image signal, whereby the corrected image signal is generated.

According to the present invention, correction corresponding to each channel can be performed even when the direction in which data lines are selected is reversed.

An image processing circuit of the present invention can be used in an electro-optical device which includes a plurality of switching elements provided corresponding to intersections of a plurality of scanning lines and a plurality of data lines, and a plurality of pixel electrodes provided corresponding to the plurality of switching elements. The electro-optical device sequentially selects the scanning lines and applies phase-expanded image signals in each block, which includes the plurality of data lines, in a period during which each of the scanning lines is selected. The image processing circuit includes a phase expansion device that phase-expands an input image signal into image signals on a plurality of channels; and a correction device that generates, in synchronization with a period in which the block is selected, each correction signal to correct an error synchronized with the period in which the block is selected and to correct each of the image signals, whereby the phase-expanded image signals are generated.

According to the present invention, each correction signal is generated in synchronization with the period during which the block is selected, and the input image signal is corrected based on each correction signal. Thus, the error in each channel, which occurs in the step of generating the phase-expanded image signals, can be canceled, and the quality of a displayed image can be enhanced.

Preferably, the correction device includes a latch circuit group that latches each correction signal in the period in which the block is selected; and a plurality of combining circuits that combine each output signal of the latch circuit group with each of the image signals, whereby the phase-expanded image signals are generated.

Preferably, the correction device selects each correction signal in accordance with a direction in which the data lines are selected and generates the phase-expanded image signals based on the selected correction signal and each of the image signals. Preferably, the correction device includes a latch circuit group that latches each correction signal in the period in which the block is selected; a plurality of combining circuits that combine each output signal of the latch circuit group with each of the image signals, whereby the phase-expanded image signals are generated; and a supplying circuit that supplies each output signal of the latch circuit group to the plurality of combining circuits based on a control signal indicating a direction in which the data lines are selected.

According to the present invention, each signal is corrected after being split into channels. Thus, an error in each channel can be canceled, and the quality of a displayed image can be enhanced.

An electronic apparatus of the present invention includes the above-described image processing circuit; a scanning-line driving device that sequentially selects the scanning lines; and a block driving device that sequentially selects blocks, each including a plurality of data lines, in a period during which each of the scanning lines is selected, and that supplies the phase-expanded image signals to the corresponding data lines belonging to the selected block.

For example, a video projector, a notebook personal computer, and a cellular phone fall under the category of the electronic apparatus.

A correction-data generating method of the present invention generates correction data used to correct an error in a block period in a projector having an electro-optical panel which includes switching elements provided corresponding to intersections of scanning lines and data lines, and pixel electrodes provided corresponding to the switching elements. The electro-optical panel sequentially selects the scanning lines and applies phase-expanded image signals in each block, which include a plurality of data lines, in a period during which each of the scanning lines is selected. The correction-data generating method includes displaying on a screen gray levels corresponding to measurement levels of a plurality of measurement blocks for generating the correction data, and displaying on the screen gray levels corresponding to reference levels of a plurality of reference blocks which are provided among the plurality of measurement blocks and which are used as the basis for determining positions of the measurement blocks; generating an image signal by capturing an image on the screen using a video camera, comparing the image signal with a threshold for distinguishing the measurement levels from the reference levels, and detecting the measurement blocks based on the comparison result; and generating the correction data for each data line based on image signals corresponding to the measurement blocks.

According to the present invention, a measurement block of a displayed image can be detected. By detecting the correspondence between a vertical line and a data line, correction data in accordance with the correspondence can be generated.

Preferably, in the step of generating the correction data for each data line, the correction data is generated for each data line based on an image signal corresponding to the measurement block that is not adjacent to the reference block.

According to the present invention, correction data can be generated based on a block that is riot influenced by block ghosting.

Preferably, in the step of generating the correction data for each data line, the correction data is generated based on an average image signal generated by averaging the image signals corresponding to the measurement blocks.

According to the present invention, the influence of noise can be suppressed by averaging the image signals. Thus, accurate correction data can be generated.

Preferably, in the step of generating the correction data for each data line, the correction data is generated based on an average image signal generated by averaging the image signals corresponding to the measurement blocks located in a partial region of the screen. For example, the correction data may be generated based on the measurement blocks located in all or some of the upper left comer region, the upper right comer region, the lower left corner region, the lower right comer region, and the central region. In this case, the calculation time can be reduced since the averaging of image signals in all measurement blocks is not performed.

DETAILED DESCRIPTION OF PREFERRED EMBODIMENTS

Hereinafter embodiments of the present invention will be described with reference to the drawings. In these embodiments, a projector using an active-matrix LCD panel, as an example of an electro-optical device, will be described.

<1. First Embodiment>

<1-1: Overall Configuration of Projector>

Figure 1:
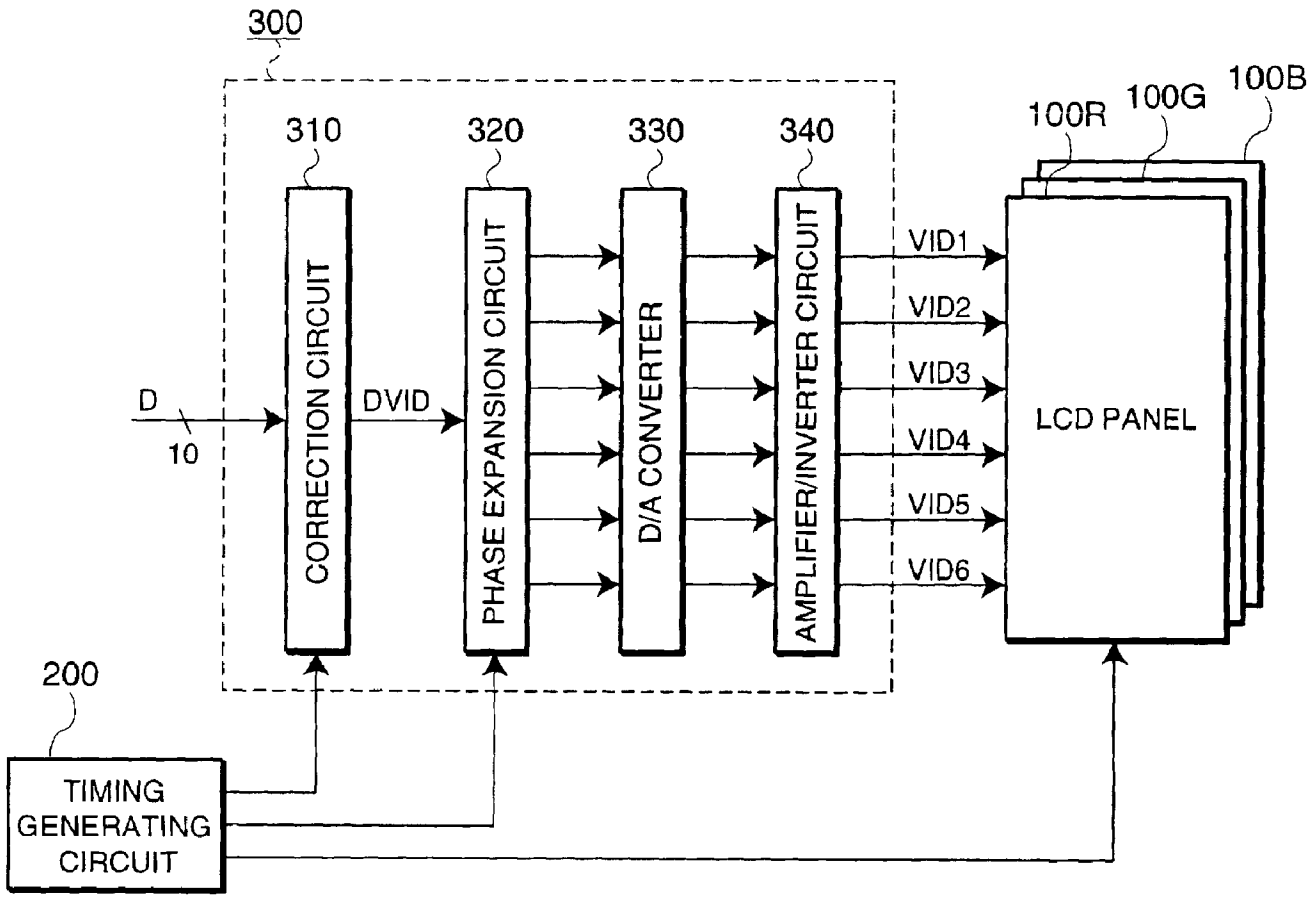
FIG. 1 is a schematic showing the electrical configuration of a projector according to a first embodiment of the present invention.

FIG. 1 is a schematic showing the electrical configuration of a projector. As shown in FIG. 1, a projector 1100 includes three LCD panels 100R, 100G, and 100B, a timing generating circuit 200, and an image processing circuit 300.

The LCD panels 100R, 100G, and 100B correspond to the three primary colors, namely, R (red), G (green), and B (blue). Each panel is formed by holding liquid crystal between a device substrate and an opposing substrate. In addition to a display region, a data-line driving circuit and a scanning-line driving circuit are formed in the periphery of the device substrate. In the following description, when a description is common to the three colors, the reference numeral "100" is collectively assigned to the LCD panels.

The timing generating circuit 200 supplies various timing signals to the scanning-line driving circuit, the data-line driving circuit, or the image processing circuit 300. The image processing circuit 300 generates phase-expanded image signals VID1 to VID6 based on 10-bit input image data Din and supplies the generated phase-expanded image signals VID1 to VID6 to the LCD panels 100R, 100G, and 100B. Although one piece of image data Din and one image processing circuit 300 are shown in FIG. 1, actually three image processing circuits corresponding to the RGB colors are provided, and three types of input image data are externally supplied.

Figure 2:
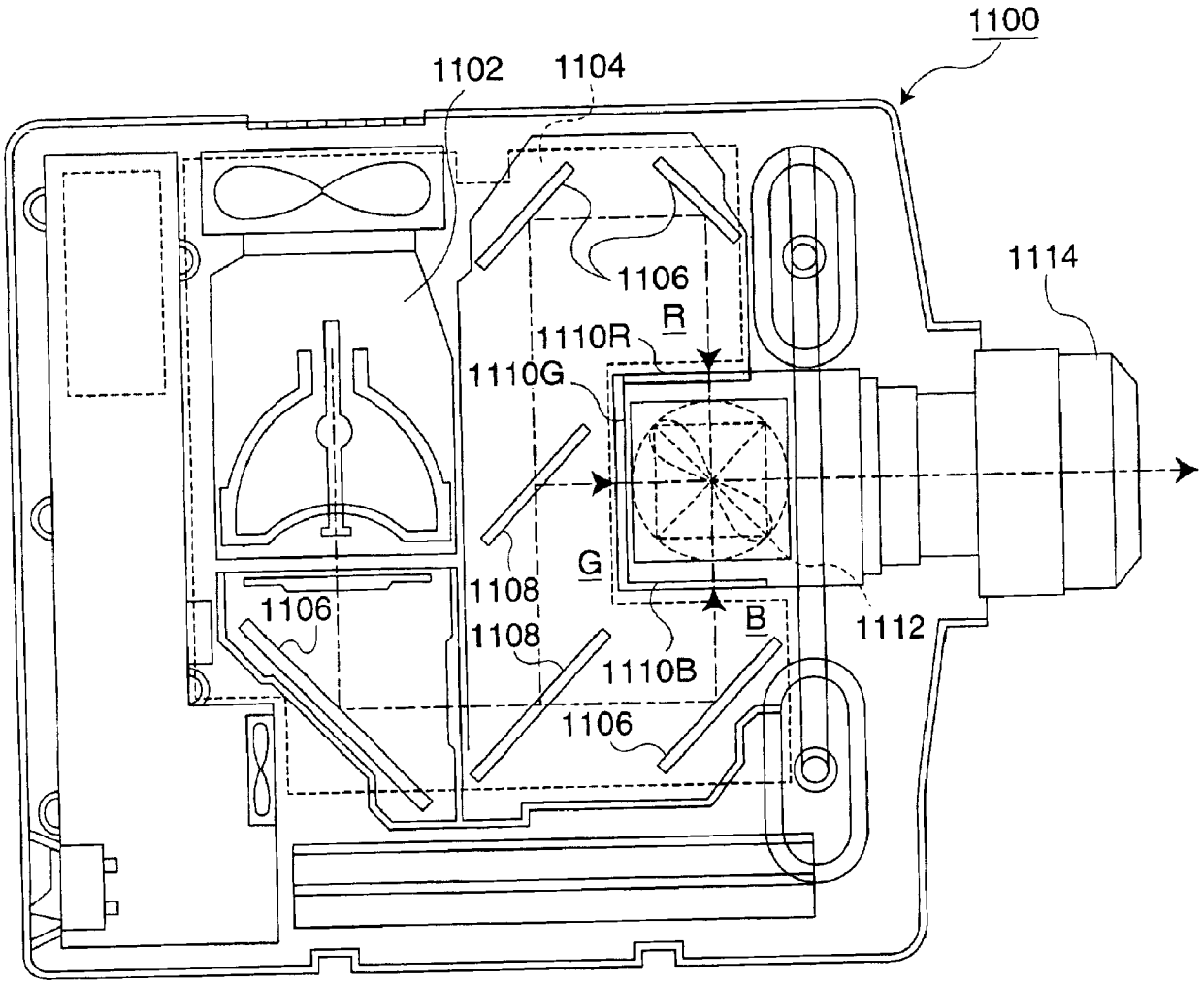
FIG. 2 is a plan view showing the mechanical configuration of the projector.

The mechanical configuration of the projector will now be described. FIG. 2 is a plan view of an example of the configuration of the projector. As shown in FIG. 2, the projector 1100 contains therein a lamp unit 1102 formed by a white light source, such as a halogen lamp. Incident light emitted from the lamp unit 1102 is separated into the three primary colors (RGB) by four mirrors 1106 and two dichroic mirrors 1108 arranged in a light guide 1104, and the separated light rays enter the LCD panels 100R, 100B, and 100G, respectively, functioning as light valves corresponding to the primary colors. The LCD panels 100R, 100G, and 100B are driven by R, G, and B image signals, respectively, supplied from an image processing circuit (not shown). Light modulated by these LCD panels enters a dichroic prism 112 from three directions. The dichroic prism 1112 refracts R and B light at 90 degrees, whereas G light is allowed to go straight. By combining images in these colors, a color image is projected onto a screen through a projection lens 1114. Since light rays corresponding to the primary colors (R, G, and B) are caused by the dichroic mirrors 1108 to enter the LCD panels 100R, 100G, and 100B, respectively, it is unnecessary to provide color filters on the opposing substrates.

Modes of using the projector include: a mode of using the projector by installing the projector on the floor, and a mode of using the projector by hanging the projector from the ceiling while having the back of the projector facing toward the ceiling. When the mode of use is changed, the positional relationship of the LCD panel 100 to the screen is reversed vertically and horizontally. In the LCD panel 100, the scanning direction can be reversed both vertically and horizontally in accordance with transfer direction control signals DIRX and DIRY.

<1-2: LCD Panel>

Figure 3:
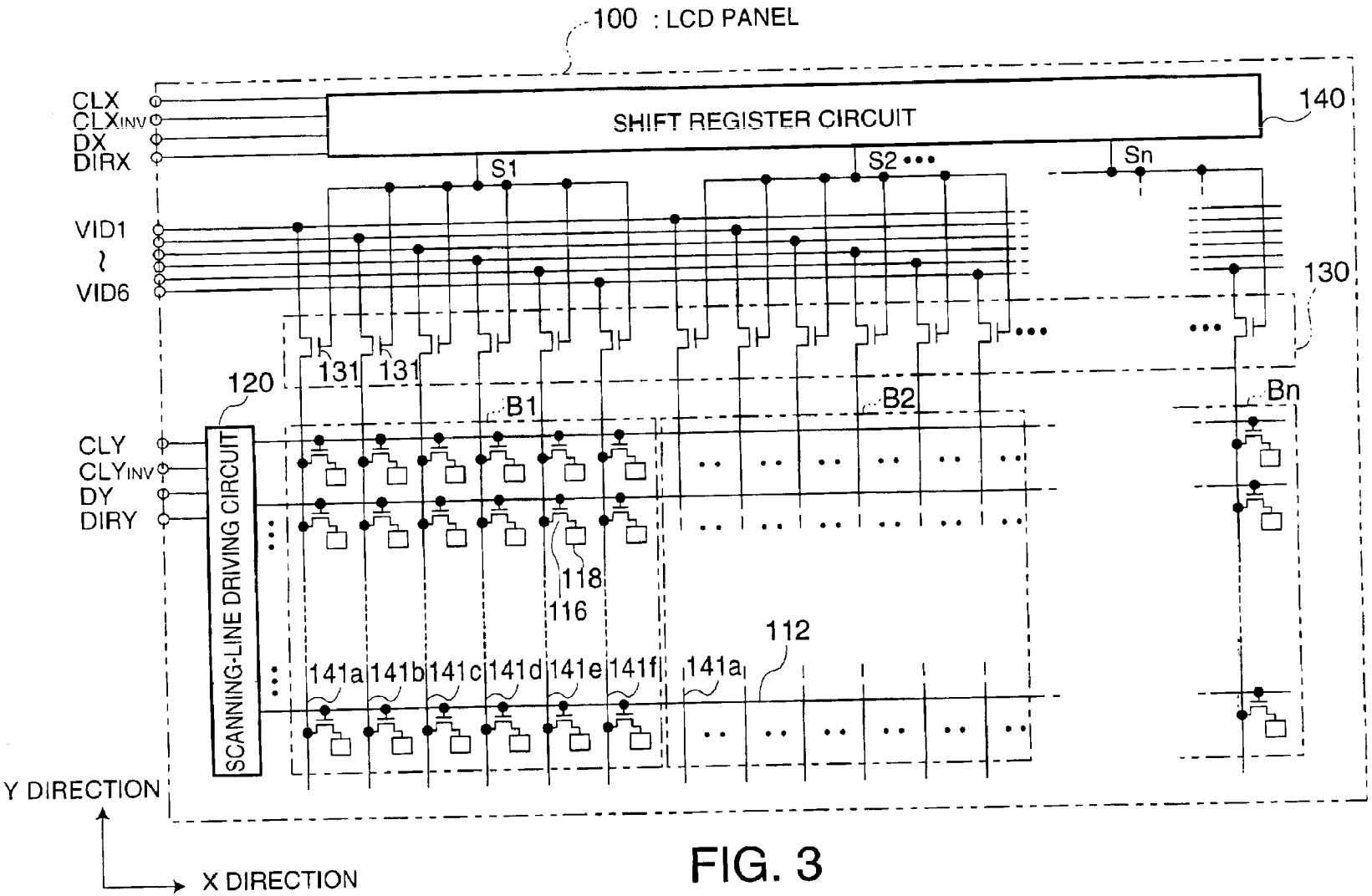
FIG. 3 is a schematic showing the configuration of an LCD panel.

The LCD panel 100 will now be described. FIG. 3 is a schematic showing the configuration of the LCD panel 100. The LCD panel 100 is formed by the device substrate and the opposing substrate, which are opposed to each other, with a gap therebetween, the gap being filled with liquid crystal.

The device substrate and the opposing substrate are formed by a quartz substrate or hard glass.

The opposing substrate has a plurality of scanning lines 112, which is set in array and which is formed in parallel to the X direction in FIG. 3, and a plurality of data lines 114, which is formed in parallel to the Y direction orthogonal to the X direction. The data lines 114 are grouped into blocks in units of six. These blocks are referred to as blocks B1 to Bm. In order to simplify the following description, the reference numeral 114 is associated with the data lines in general. When specific data lines are indicated, the reference numerals 114*a* to 114*f* are used.

At intersections of the scanning lines 112 and the data lines 114, thin film transistors (hereinafter "TFTs") 116 functioning as switching elements are provided. Gate electrodes of the TFTs 116 are connected to the scanning lines 112. Source electrodes of the TFTs 116 are connected to the data lines 114. Drain electrodes of the TFTs 116 are connected to pixel electrodes 118. Each pixel is formed by the pixel electrode 118, a common electrode formed on the opposing substrate, and liquid crystal held between the pixel electrode 118 and the common electrode. At intersections of the scanning lines 112 and the data lines 114, the pixels are arranged in the form of a matrix. In addition, a hold capacitor (not shown) is formed while being connected to each pixel electrode 118.

A scanning-line driving circuit 120 is formed on the device substrate. The scanning-line driving circuit 120 sequentially outputs pulsed scanning signals to the scanning lines 112 in accordance with a clock signal CLY from the timing generating circuit 200, an inverted clock signal CLYINV, a transfer start pulse DY, and the transfer direction control signal DIRY. More specifically, the scanning-line driving circuit 120 sequentially shifts the transfer start pulse DY, which is supplied at the beginning of a vertical scanning period, in accordance with the clock signal CLY, and the inverted clock signal CLYINV and outputs the signal as a scanning line signal, thereby sequentially selecting the scanning lines 112. The transfer direction control signal DIRY instructs the scanning-line driving circuit 120 to select the scanning lines 112 from top to bottom or from bottom to top. The scanning-line driving circuit 120 changes the direction in which the scanning lines 112 are selected in accordance with the transfer direction control signal DIRY.

In contrast, a sampling circuit 130 has sampling switches 131 for the data lines 114. A switch 131 is provided for each data line 114 at one end thereof. These switches 131 are formed by TFTs formed on the same device substrate. The phase-expanded image signals VID1 to VID6 are input to source electrodes of the switches 131.

Gate electrodes of six switches 131 connected to the data lines 114*a* to 114*f* of the block B1 are connected to a signal line to which a sampling signal S1 is supplied. Gate electrodes of six switches 131 connected to the data lines 114*a* to 114*f* of the block B2 are connected to a signal line to which a sampling signal S2 is supplied. Similarly, gate electrodes of six switches 131 connected to the data lines 114*a* to 114*f* of the block Bm are connected to a signal line to which a sampling signal Sm is supplied. The sampling signals S1 to Sm are signals to sample the phase-expanded image signals VID1 to VID6 in each block within a horizontal effective display period.

A data-line driving circuit 140 is formed on the same device substrate. The data-line driving circuit 140 sequentially outputs the sampling signals S1 to Sm in accordance with a clock signal CLX from the timing generating circuit 200, an inverted clock signal CLXINV, a transfer start pulse DX, and the transfer direction control signal DIRX. More specifically, the data-line driving circuit 140 sequentially shifts the transfer start pulse DX, which is supplied at the beginning of a horizontal scanning period, in accordance with the clock signal CLX and the inverted clock signal CLXINV, reduces the pulse width of the shifted signals so that the adjacent signals do not overlap each other, and sequentially outputs the signals as the sampling signals S1 to Sm. The transfer direction control signal DIRX instructs the data-line driving circuit 140 to select the data lines 114 from left to right or from right to left. The data-line driving circuit 140 changes the direction in which the data lines 114 are selected in accordance with the transfer direction control signal DIRX.

With this arrangement, when the sampling signal S1 is output, the phase-expanded image signals VID1 to VID6 are sampled on six data lines 114*a* to 114*f* belonging to the block B1, and the phase-expanded image signals VID1 to VID6 are written by the corresponding TFTs 116 to six pixels on the scanning line selected at that time.

Subsequently, when the sampling signal S2 is output, the phase-expanded image signals VID1 to VID6 are sampled on six data lines 114*a* to 114*f* belonging to the block B2, and the phase-expanded image signals VID1 to VID6 are written by the corresponding TFTs 116 to six pixels on the scanning line selected at that time.

Similarly, when the sampling signals S3, S4, . . . , Sm are sequentially output, the phase-expanded image signals VID1 to VID6 are sampled on six data lines 114*a* to 114*f* belonging to the blocks B3, B4, . . . , Bm, and the phase-expanded image signals VID1 to VID6 are written to six pixels on the scanning line selected at that time. Subsequently, the next scanning line is selected, and similar writing is repeatedly performed in the blocks B1 to Bm.

According to this driving system, the number of stages of the data-line driving circuit 140 to drive and control the switches 131 in the sampling circuit 130 is reduced to ⅙ compared with a system to drive the data lines by a dot sequential method. Furthermore, the frequency of the clock signal CLX and the frequency of the inverted clock signal CLXINV, which are to be supplied to the data-line driving circuit 140, are reduced to ⅙. In addition to the reduction in number of stages, power consumption can be reduced.

<1-3: Image Processing Circuit>

An image processing circuit 300A will now be described. As shown in FIG. 1, the image processing circuit 300A has a correction circuit 310, a phase expansion circuit 320, a D/A converter circuit 330, and an amplifier/inverter circuit 340. Among these circuits, the correction circuit 310 corrects transfer characteristics from the phase expansion circuit 320 to the amplifier/inverter circuit 340 in accordance with correction data and generates corrected image data DVID.

When the corrected image data DVID on one channel is input to the phase expansion circuit 320, the phase expansion circuit 320 expands the corrected image data DVID into data in N phases (N=6 in the drawing) and outputs the data in N phases. The output data from the phase expansion circuit 320 is converted from a digital signal to an analog signal by the D/A converter 330, and the analog signal is supplied to the amplifier/inverter circuit 340.

The amplifier/inverter circuit 340 appropriately inverts the polarity of the input signals under the following condition, amplifies the inverted signals, and supplies the resultant signals as the phase-expanded image signals VID1 to VID6, which are phase-expanded, to the LCD panel 100. The polarity inversion means to alternately invert the voltage level of an image signal on the basis of an amplitude central potential of the image signal as a reference potential. Whether to invert the polarity is determined in accordance with a method of applying a data signal: (1) polarity inversion in scanning line units, (2) polarity inversion in data signal line units, or (3) polarity inversion in pixel units. The inversion period is set to one horizontal scanning period or to a dot clock period.

<1-4: Correction Circuit>

Figure 4:
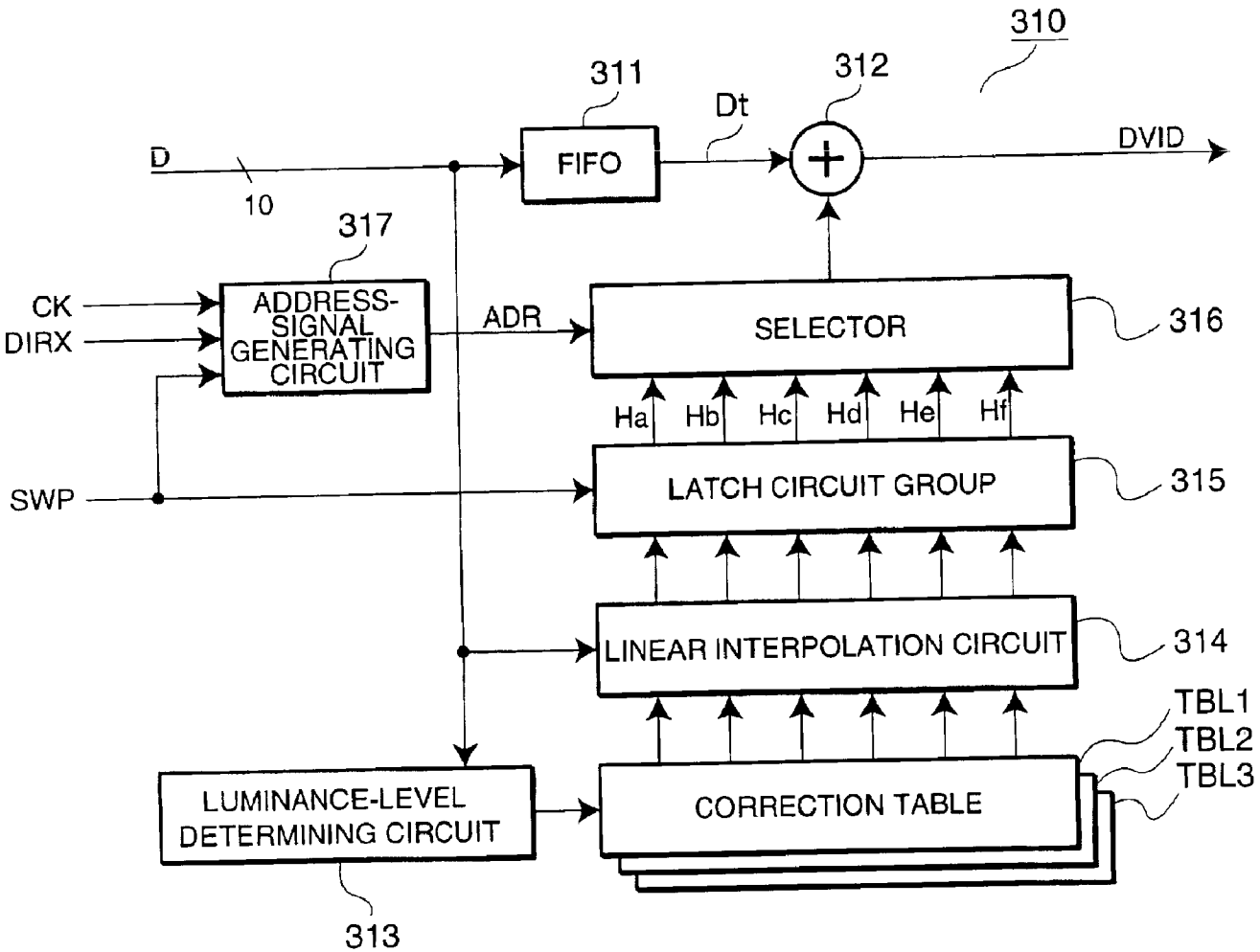
FIG. 4 is a schematic of a correction circuit used in the projector.

FIG. 4 is a schematic showing the detailed configuration of the correction circuit 310. As shown in FIG. 4, the correction circuit 310 has correction tables TBL1 to TBL3. The correction table TBL1 stores six pieces of correction data HWa to HWf corresponding to the white level. The correction table TBL2 stores six pieces of correction data HGa to HGf corresponding to the intermediate level. The correction table TBL3 stores six pieces of correction data HBa to HBf corresponding to the black level.

Also, the correction data HWa, HGa, and HBa correspond to the data line 114*a*; the correction data HWb, HGb, and HBb correspond to the data line 114*b*; the correction data HWc, HGc, and HBc correspond to the data line 114*c*; the correction data HWd, HGd, and HBd correspond to the data line 114*d*; the correction data HWe, HGe, and HBe correspond to the data line 114*e*; and the correction data HWf, HGf, and HBf correspond to the data line 114*f*.

Figure 5:
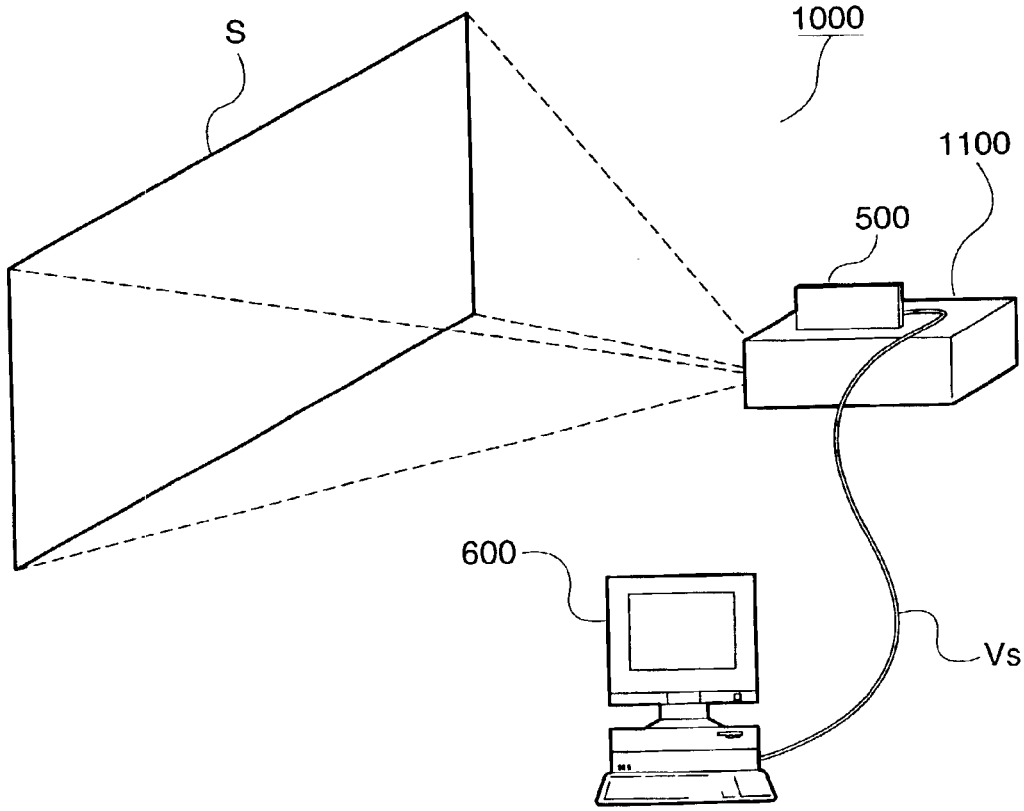
FIG. 5 is a perspective view of a system 1000 to generate correction data used in the projector.

A method for generating various correction data will now be described. FIG. 5 is a perspective view of a system 1000 to generate correction data. As shown in FIG. 5, the correction-data generating system 1000 includes the projector 1100, a CCD camera 500, a personal computer 600, and a screen S. The projector 1100 is designed to stop the operation of the correction circuit 310. An image projected by the projector 1100 is displayed on the screen S. The CCD camera 500 converts an image on the screen S into an electrical signal and supplies the electrical signal as an image signal Vs to the personal computer 600. The personal computer 600 analyzes the image signal Vs and generates correction data.

Figure 6:
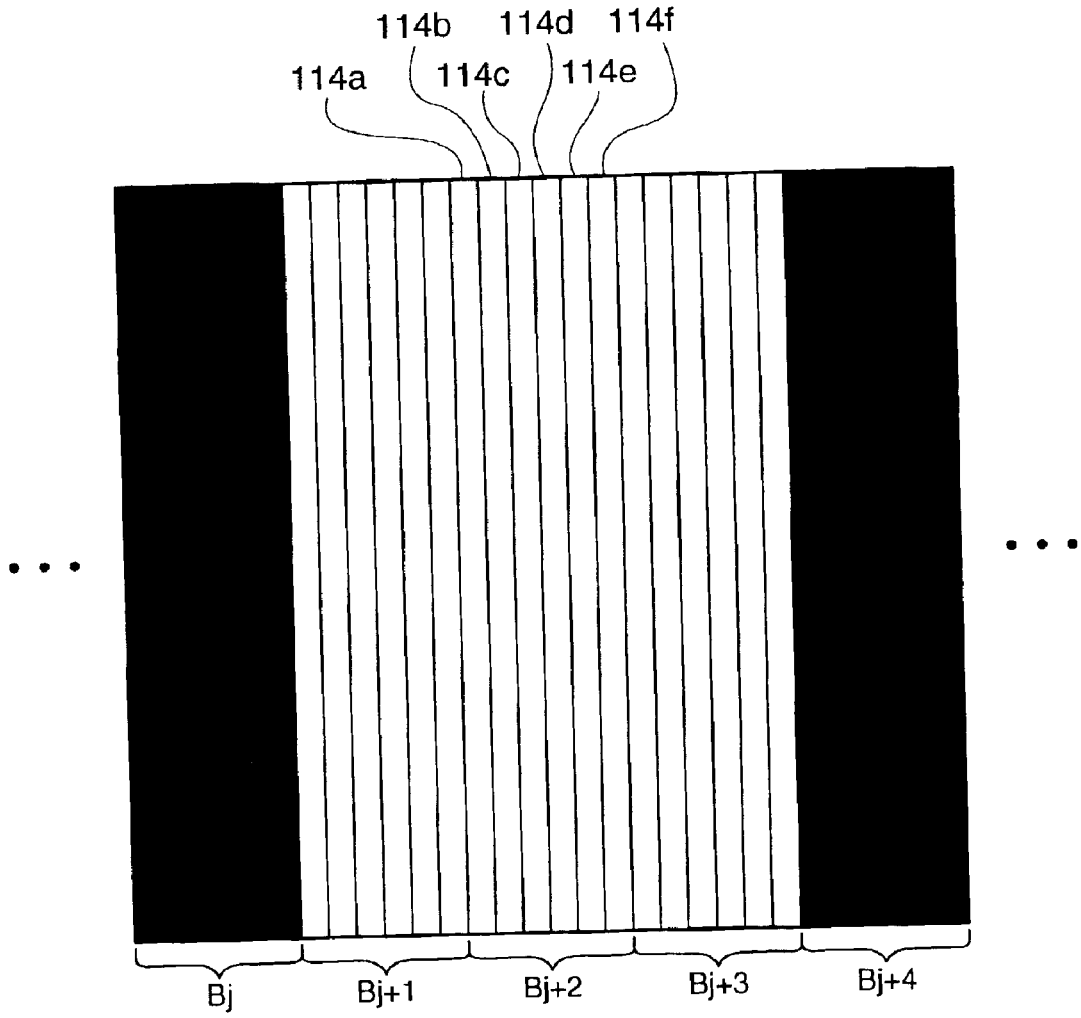
FIG. 6 is a schematic of an exemplary test image displayed by the projector.

In the above-described correction-data generating system 1000, test image data is supplied from a signal generator (not shown) to the projector 1100. The test image data is to display a solid black or a solid white reference line (reference block) every four blocks. FIG. 6 shows part of an image displayed on the screen S.

First, six pieces of correction data HWa to HWf corresponding to the white level are generated. In this case, test image data to cause a reference line (reference block) to be solid black, and to cause the other region (measurement block) to be at the white level, is supplied to the projector 1100. Second, the personal computer 600 obtains the image signal Vs, compares the image signal Vs with a predetermined threshold, and detects the reference line. The threshold is set so that when the display level of the reference line is regarded as a reference level and when the display level of the other region is regarded as a measurement level, the reference level and the measurement level can be distinguished from each other.

Third, the personal computer 600 measures the gray level of a block that is not adjacent to the reference line in each of the data lines 114*a* to 114*f*. In the example shown in FIG. 6, a block Bj and a block Bj+4 are reference lines. Thus, a block Bj+1 and a block Bj+3 are adjacent to the adjacent reference lines. In contrast, a block Bj+2 is not adjacent to the reference line. Thus, correction data is generated based on the image signal Vs in the block Bj+2. Specifically, the correction data value is set so that an error can be cancelled when correction data is added to input image data based on a difference between the white level and the actually-measured image signal Vs. Correction data generated from a region corresponding to the data line 114*a* is represented by the reference symbol HWa; correction data generated from a region corresponding to the data line 114*b* is represented by the reference symbol HWb; correction data generated from a region corresponding to the data line 114*c* is represented by the reference symbol HWc; correction data generated from a region corresponding to the data line 114*d* is represented by the reference symbol HWd; correction data generated from a region corresponding to the data line 114*e* is represented by the reference symbol HWe; and correction data generated from a region corresponding to the data line 114*f* is represented by the reference symbol HWf.

The correction data HGa to HGf corresponding to the intermediate level are generated in a similar fashion. In contrast, the correction data HBa to HBf corresponding to the black level are displayed while making the reference line to be solid white. This is performed to make it easier to distinguish the reference line from the other region since the region other than the reference line displays the black level.

With the foregoing processing, the generated correction data HWa to HWf, HGa to HGf, and HBa to HBf are stored in the correction tables TBL1 to TBL3. The correction data may be generated by averaging the errors in all screens projected onto the screen S, or by averaging the errors obtained from predetermined regions, such as the upper left comer region, the upper right comer region, the central region, the lower left comer region, and the lower right comer region.

The description of the correction circuit 310 continues referring again to FIG. 4. A luminance-level determining circuit 313 compares the luminance level of input image data Din with a predetermined reference level and outputs a determination signal. In this example, the intermediate level used to generate the correction data HGa to HGf is used as the reference level.

A linear interpolation circuit 314 selects two tables from among the correction tables TBL1 to TBL3 in accordance with the determination signal, reads correction data from the tables, interpolates the correction data based on the input image data Din, and generates correction data Ha to Hb.

A latch circuit group 315 latches each piece of output data from the linear interpolation circuit 314 in synchronization with a block signal SWP. The period of the block signal SWP is six times the period of the dot clock signal. The block signal SWP is a signal that changes from the L level to the H level when the block is changed.

A selector 316 selects data from among the correction data Ha to Hf, which are output from the latch circuit group 315, in accordance with an address signal ADR and supplies the selected data to an adder circuit 312. More specifically, when the address signal ADR indicates values (000), (001), . . . , (101), the correction data Ha, Hb, . . . , Hf are selected, respectively.

An address-signal generating circuit 317 is formed by an up-down counter. The address-signal generating circuit 317 counts clock signals CK and outputs the count as the address signal ADR. The count is reset by the block signal SWP. In the address-signal generating circuit 317, the operation of counting-up and counting-down is controlled, and the initial value to which the count is reset can be changed in accordance with the transfer direction control signal DIRX. More specifically, the address-signal generating circuit 317 starts counting up from the initial value (000) when the transfer direction control signal DIRX instructs left-to-right transfer. In contrast, when the transfer direction control signal DIRX instructs right-to-left transfer, the address-signal generating circuit 317 starts counting down from the initial value (101).

A FIFO 311 is a first-in first-out memory operated by the clock signal CK. The FIFO 311 is formed by connecting six stages of 10-bit latch circuits in cascade. Thus, delayed image data Dt output from the FIFO 311 is delayed for a period corresponding to one block. A one-block-period delay is caused by the FIFO 311 to adjust the timing because it takes time for the linear interpolation circuit 314 to perform arithmetic processing, thus causing the correction data supplied to one input terminal of the adder circuit 312 to be delayed relative to the input image data Din.

Figure 7:
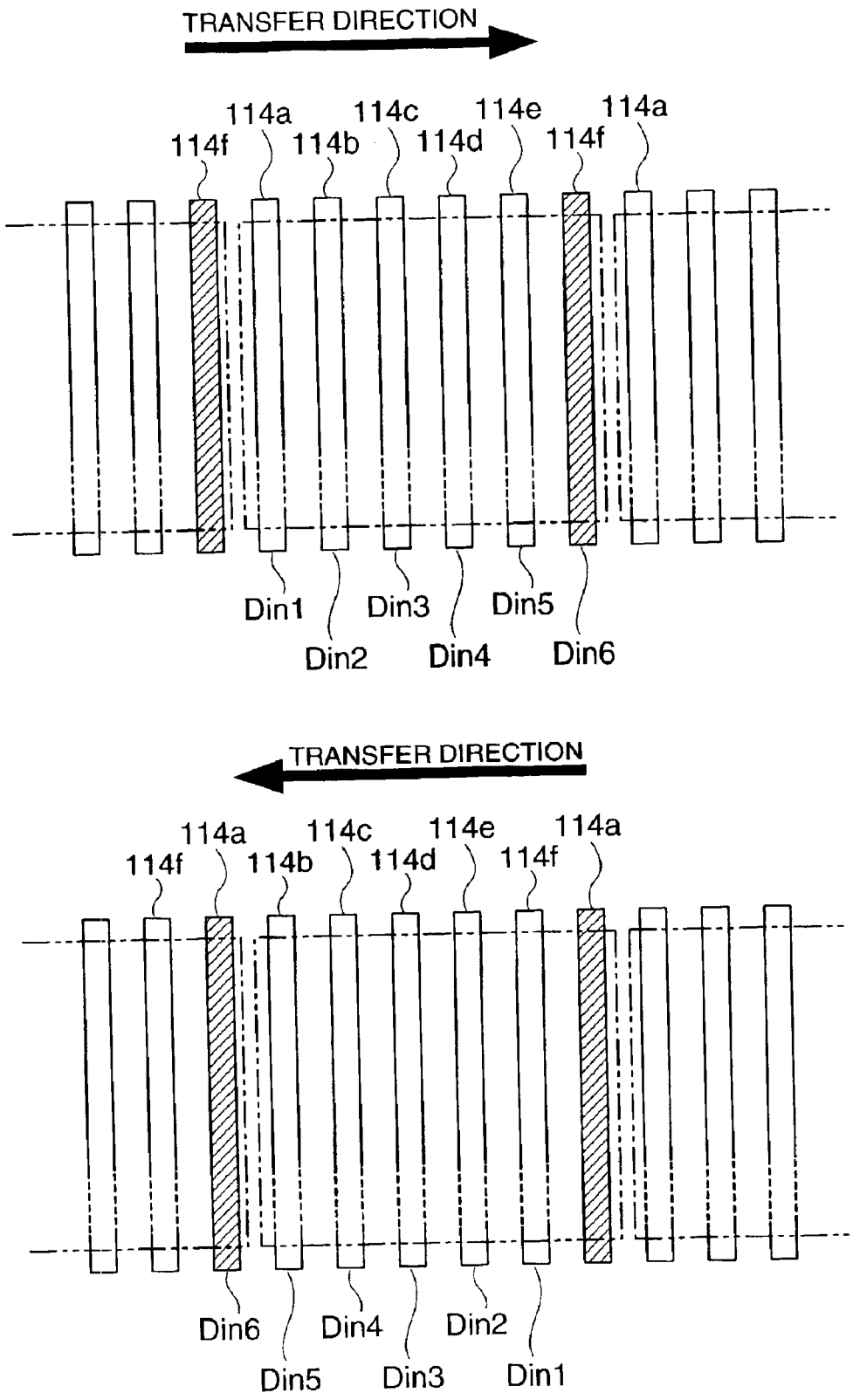
FIG. 7 is a schematic showing the relationship between a transfer direction and input image data in the projector.

The reason to control the order of occurrence of the address signal ADR in accordance with the transfer direction control signal DIRX is described referring to FIG. 7. When the transfer direction is, as shown in the upper portion of FIG. 7, from left to right, image signals corresponding to the input image data Din1→Din2→ . . . →Din6 are supplied to the data lines in the order of 114*a*→114*b*→ . . . →114*f*. When the transfer direction is, as shown in the lower portion of FIG. 7, from right to left, image signals corresponding to the input image data Din1→Din2→ . . . →Din6 are supplied to the data lines in the order of 114*f*→114*e*→ . . . →114*a*. In contrast, the correction data are generated corresponding to the data lines 114*a* to 114*f*. In order to realize the correspondence between the correction data and the input image data, it is necessary to change the correction data in accordance with the transfer direction control signal DIRX. Thus, the order of occurrence of the address signal ADR is reversed in accordance with the transfer direction control signal DIRX.

<1-5: Operation of Projector>

Figure 8:
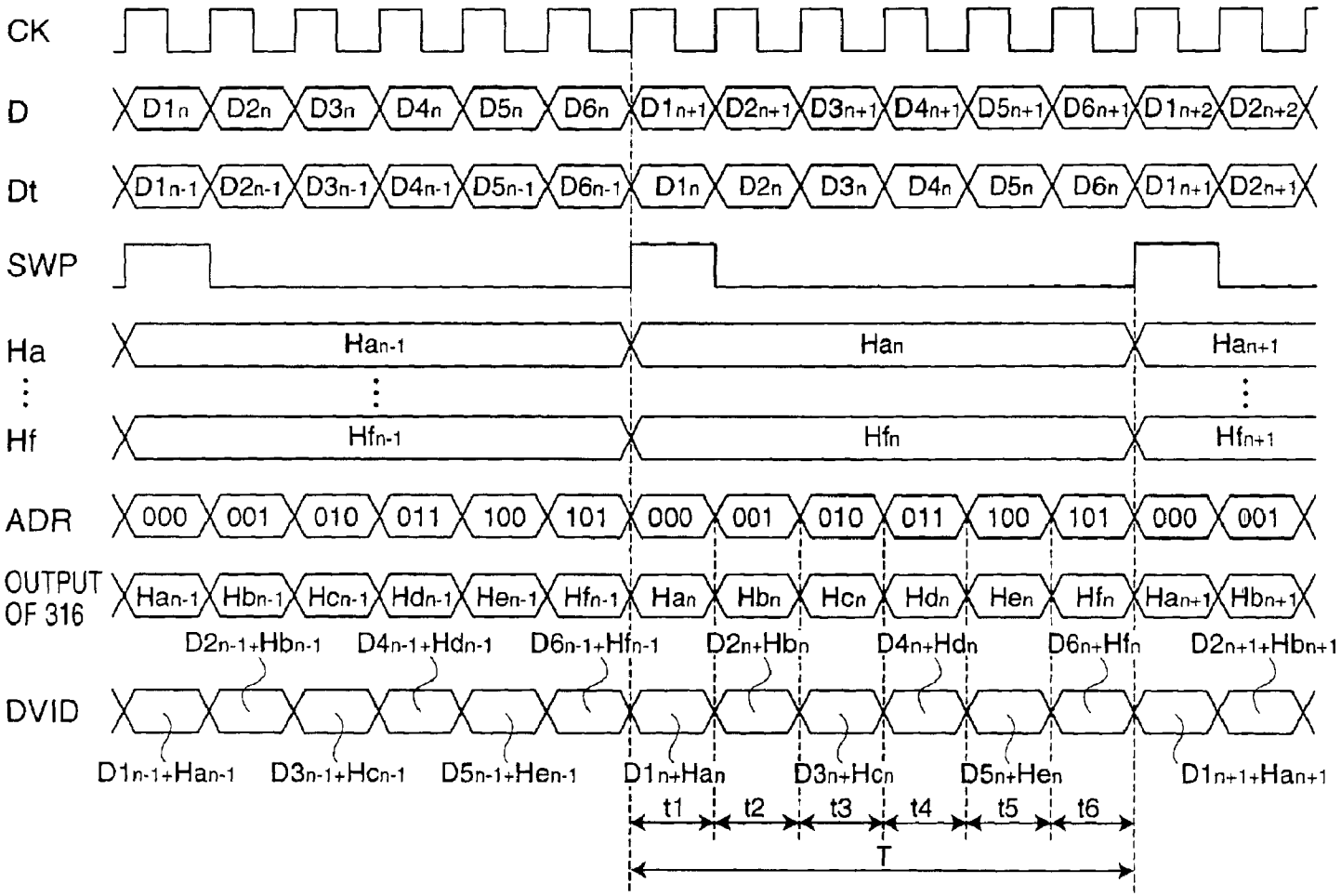
FIG. 8 is a timing chart showing the operation of the correction circuit used in the projector when the transfer direction is from left to right.
Figure 9:
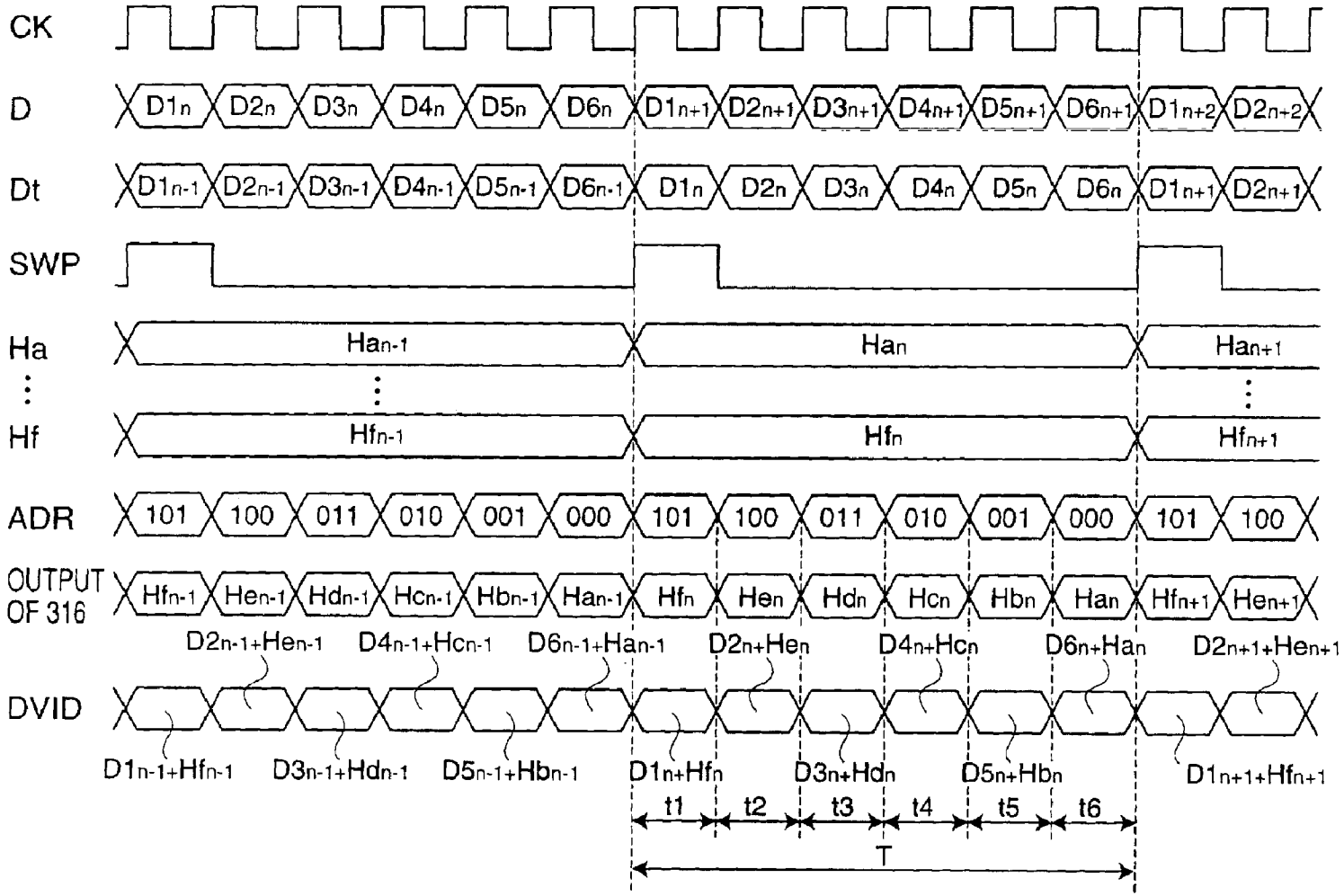
FIG. 9 is a timing chart showing the operation of the correction circuit used in the projector when the transfer direction is from right to left.

The operation of the projector will now be described. First, the operation of the correction circuit 310 is described. FIG. 8 is a timing chart showing the operation of the correction circuit 310 when the transfer direction indicated by the transfer direction control signal DIRX is from left to right. FIG. 9 is a timing chart showing the operation of the correction circuit 310 when the transfer direction indicated by the transfer direction control signal DIRX is from right to left. A case in which the transfer direction is from left to right will now be considered. As shown in FIG. 8, the input image data Din is in synchronization with the clock signal CK. The delayed image data Dt, which is the output data of the FIFO 311, is delayed relative to the input image data Din for six periods of the clock signal CK. In other words, the delayed image data Dt is delayed for one period of the block signal SWP.

As a result, the delayed image data Dt, D1*n*, D2*n*, . . . , D6*n* can be obtained in a period T. At the same time, the latch circuit group 315 outputs correction data Han to Hfn in the period T. When the block signal SWP becomes active in a period t1, the count of the address-signal generating circuit 317 is reset, and the address signal ADR becomes (000). The address-signal generating circuit 317 counts up the clock signals CK, and the address signal ADR is incremented thus: (001), (010), . . . , (101).

In periods t1 to t6, the selector 316 sequentially outputs the correction data Han to Haf. The correction data Han to Haf are added to the delayed image data Dt (D1*n* to D6*n*) by the adder circuit 312, thus obtaining corrected image data DVID. For example, "D1*n*+Han" is output as the corrected image data DVID in the period t1.

In contrast, when the transfer direction indicated by the transfer direction control signal DIRX is from right to left, as shown in FIG. 9, if the block signal SWP becomes active in the period t1, the count of the address-signal generating circuit 317 is reset, and the address signal ADR becomes (101). The address-signal generating circuit 317 counts down the clock signals CK, and the address signal ADR is decremented thus: (101), (100), . . . , (000).

Accordingly, the selector 316 sequentially outputs the correction data Hfn to Han in the periods t1 to t6. The correction data Hfn to Han are added to the delayed image data Dt (D1*n* to D6*n*) by the adder circuit 312, thus obtaining corrected image data DVID. For example, "D1*n*+Hfn" is output as the corrected image data DVID in the period t1.

Figure 10:
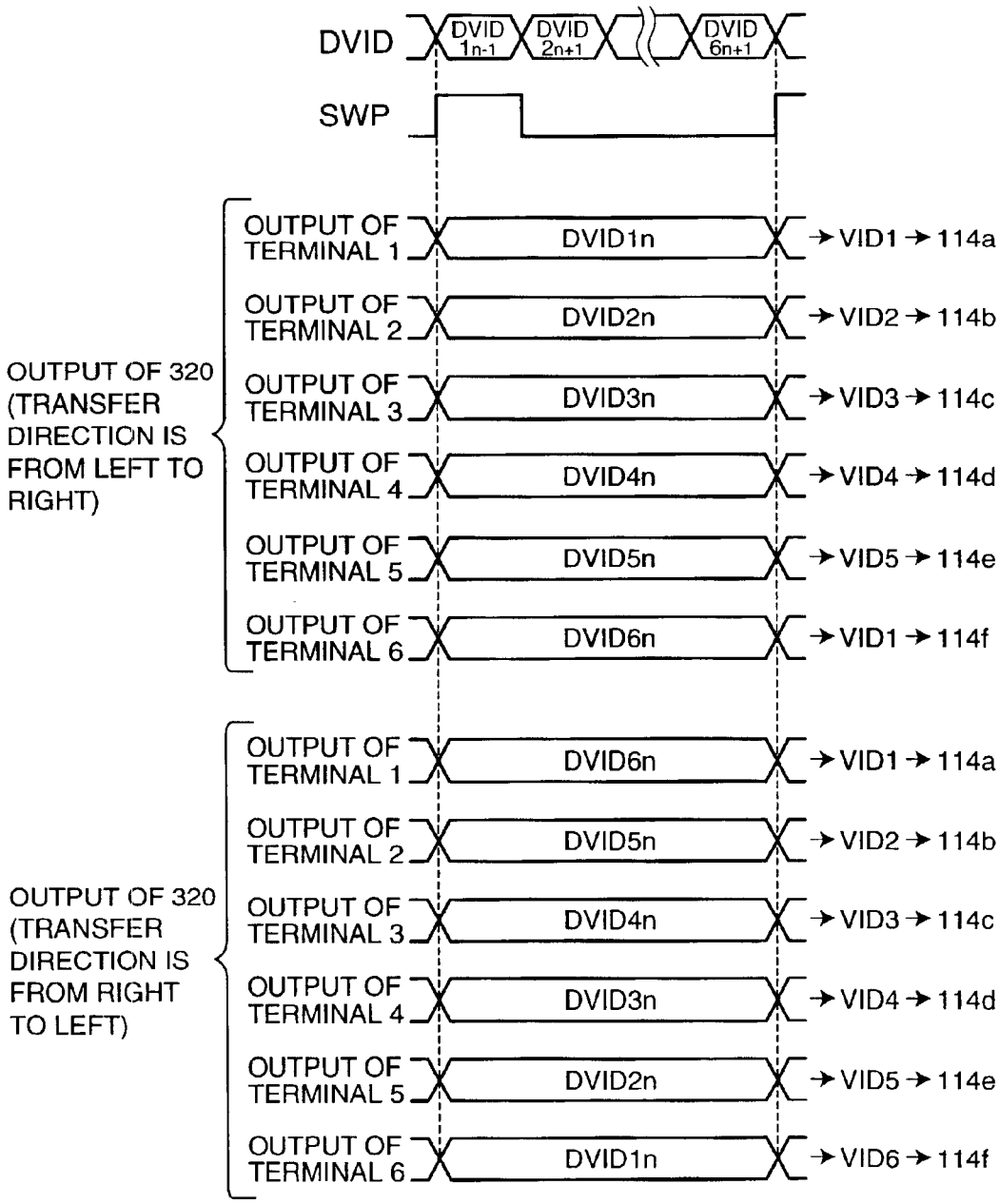
FIG. 10 is a timing chart showing the operation of a phase expansion circuit 320 in the projector, which supplies a data signal to data lines 114*a* to 114*f;*

The operation of the phase expansion circuit 320, which supplies a data signal to the data lines 114*a* to 114*f*, is described referring to a timing chart shown in FIG. 10.

The phase expansion circuit 320 performs serial-parallel conversion on the corrected image data DVID, and converts the corrected image data DVID into image data on six channels in one period of the block signal SWP. The image data on six channels are output from output terminals 1 to 6 of the phase expansion circuit 320 shown in FIG. 1. The order of outputting the image data differs depending on the transfer direction indicated by the transfer direction control signal DIRX. In the example shown in FIG. 10, when the transfer direction indicated by the transfer direction control signal DIRX is from left to right, the output terminals 1, 2, . . . , 6 of the phase expansion circuit 320 output DVID1*n*, DVID2*n*, . . . , DVID6*n*, respectively. In contrast, when the transfer direction indicated by the transfer direction control signal DIRX is from right to left, the output terminals 1, 2, . . . , 6 of the phase expansion circuit 320 output DVID6*n*, DVID5*n*, . . . , DVID1*n*, respectively.

These pieces of image data are converted by the D/A converter 330 into analog signals. The analog signals are amplified/inverted by the amplifier/inverter circuit 340, and the resultant signals are supplied as phase-expanded image signals VID1 to VID6 to the LCD panel 100.

In the LCD panel 100, six data lines 114*a* to 114*f* are grouped into a block. The phase-expanded image signals VID1 to VID6 are simultaneously supplied to the data lines 114*a* to 114*f* belonging to each block. For example, when the transfer direction indicated by the transfer direction control signal DIRX is from left to right, as shown in FIG. 10, the phase-expanded image signal VID1 based on the corrected image data DVID1*n* is supplied to the data line 114*a*, where DVID1*n* corresponds to the data "D1*n*+Han" in the period t1 shown in FIG. 8. Since "Han" is generated based on the correction data corresponding to the data line 114*a*, the corrected image signal is supplied to the data line 114*a*. In contrast, when the transfer direction indicated by the transfer direction control signal DIRX is from right to left, as shown in FIG. 10, the phase-expanded image signal VID1 based on the corrected image data DVID6*n* is supplied to the data line 114*a*, where DVID6*n* corresponds to the data "D6*n*+Han" in the period t6 shown in FIG. 8. Since "Han" is generated based on the correction data corresponding to the data line 114*a*, the corrected image signal is supplied to the data line 114*a*.

When a plurality of data lines 114 is selected at the same time, image data on one channel is split into image data on a plurality of channels, and the split pieces of image data are subjected to D/A conversion and amplification/inversion, thus generating image signals. In this embodiment, when there is an error or a variation in transfer characteristics, such as gain in the D/A conversion and amplification/inversion, the correction data generated in advance to cancel the error and variation is added to the input image data Din. Thus, the block period noise can be suppressed, and the quality of a displayed image can be greatly enhanced.

When an image on the screen S is to be inverted and displayed, it is necessary to reverse the direction in which the data lines 114 are selected. In this embodiment, in such a case, the correction data is selected in accordance with the direction in which the data lines are selected. Thus, even when a flip horizontal image is to be displayed, the block period noise can be suppressed, and the quality of the displayed image can be greatly enhanced.

The data value of the correction data changes in accordance with the data value of the input image data Din. If correction data corresponding to all values available to the input image data Din is stored in advance, it is necessary to use a large correction table. In this embodiment, correction data corresponding to a few typical values are stored, and correction data corresponding to intermediate values are computed by linear interpolation. Thus, the storage capacity of the correction table can be reduced.

<2: Second Embodiment>

A projector according to a second embodiment will now be described. The electrical configuration of the projector of the second embodiment is similar to that of the projector of the first embodiment, which is shown in FIG. 1, except for the fact that an image processing circuit 300B is used in place of the image processing circuit 300A. The mechanical configuration of the projector of the second embodiment is similar to that of the projector of the first embodiment, which is shown in FIG. 2.

Figure 11:
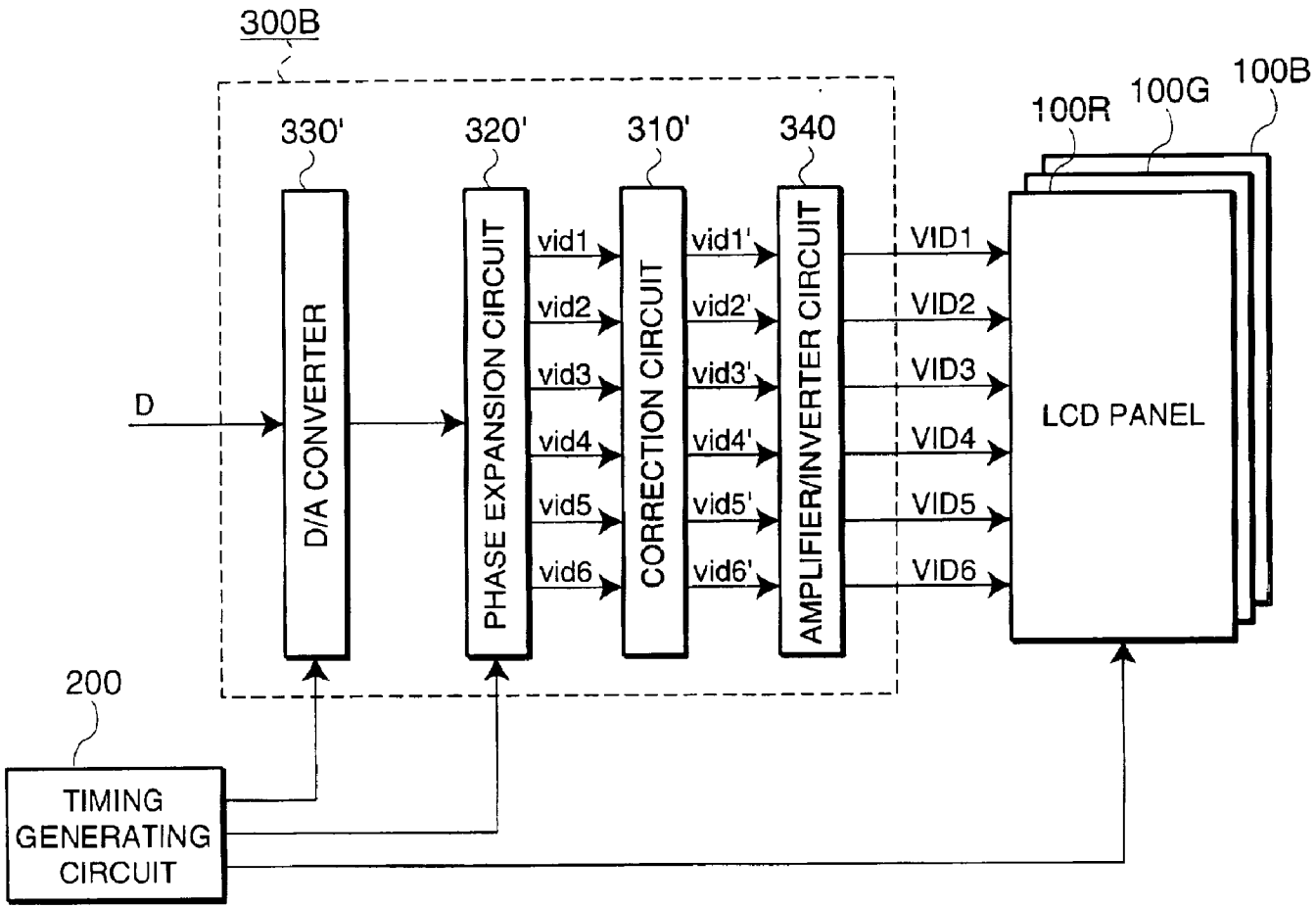
FIG. 11 is a schematic showing the electrical configuration of a projector according to a second embodiment.

FIG. 11 is a schematic showing the electrical configuration of the projector according to the second embodiment. As shown in FIG. 11, the image processing circuit 300B of the second embodiment uses a D/A converter 330' to convert the input image data Din into an analog signal. Subsequently, the analog signal is subjected to phase expansion, correction, and amplification/inversion. Thus, a phase expansion circuit 320' differs from the phase expansion circuit 320, shown in FIG. 1, which handles digital signals in that the phase expansion circuit 320' handles analog signals. The fact that an image signal on one channel is split into image signals on six channels and the fact that the time base of the image signals is expanded six times are similar to those in the first embodiment.

Figure 12:
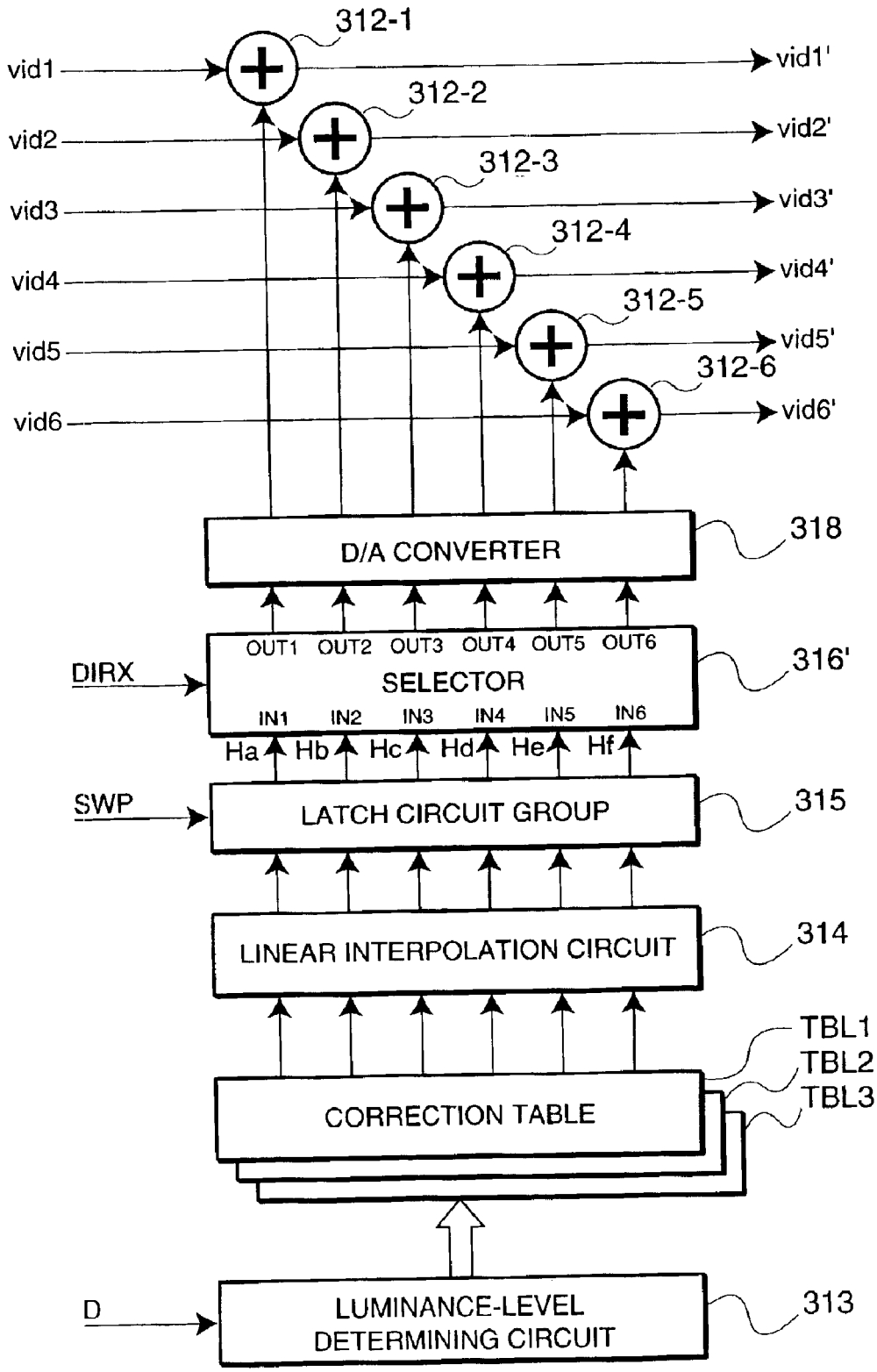
FIG. 12 is a schematic showing the configuration of a correction circuit used in the projector.

FIG. 12 is a schematic showing the configuration of a correction circuit 310'. The configuration of the correction circuit 310' is similar to that of the correction circuit 310 of the first embodiment, which is shown in FIG. 4, except for the fact that the correction circuit 310' uses a selector 316' in place of the selector 316, that the correction circuit 310' has a D/A converter 318, and that the correction circuit 310' has adder circuits 312-1 to 312-6.

When the transfer direction indicated by the transfer direction control signal DIRX is from left to right, the selector 316' outputs, from output terminals OUT1, OUT2, . . . , OUT6, the correction data Ha, Hb, . . . , Hf, which are supplied to input terminals IN1, IN2, . . . , IN6. In contrast, when the transfer direction indicated by the transfer direction control signal DIRX is from right to left, the selector 316' outputs, from the output terminals OUT6, OUT5, . . . , OUT1, the correction data Ha, Hb, . . . , Hf, which are supplied to the input terminals IN1, IN2, . . . , IN6.

Correction signals obtained by A/D converting the correction data Ha, Hb, . . . , Hf can be represented by ha, hb, . . . , hf. When the transfer direction indicated by the transfer direction control signal DIRX is from left to right, output signals vid1', vid2', . . . , vid6' of the adder circuits 312-1, 312-2, . . . , 312-6 are "vid1+ha", "vid2+hb", . . . , "vid6+hf". In contrast, when the transfer direction indicated by the transfer direction control signal DIRX is from right to left, the output signals vid1', vid2', . . . , vid6' are "vid1+hf", "vid2+he", . . . , "vid6+ha". As a result, even when the direction in which the data lines 114 are selected is reversed, appropriate correction can be performed.

According to the second embodiment, even when there is an error or a variation in transfer characteristics, such as gain in the D/A conversion and amplification/inversion, a correction signal generated in advance to cancel the error or variation is added to a phase-expanded image signal. Thus, the block period noise can be reduced or suppressed, and the quality of the displayed image can be greatly enhanced. Since the correction signal is selected in accordance with the direction in which the data lines are selected, even when a flip horizontal image is to be displayed, the block period noise can be suppressed, and the quality of the displayed image can be greatly enhanced. The correction data corresponding to a few typical values are stored, and correction data corresponding to intermediate values are computed by linear interpolation. Thus, the storage capacity of the correction table can be reduced.

<3. Modifications>

(1) In the foregoing embodiments, the blocks B1 to Bm are sequentially selected, and the phase-expanded image signals VID1 to VID6, which are generated by performing 6-phase expansion, are simultaneously sampled on and supplied to six data lines 114*a* to 114*b* belonging to one selected block. The number of phases in phase expansion and the number of data lines to which signals are simultaneously supplied (that is, the number of data lines forming one block) are not limited to "6". For example, the number of data lines forming one block can be 3, 12, 24, . . . , and image signals generated by performing 3-phase expansion, 12-phase expansion, and 24-phase expansion and supplied in parallel can be simultaneously supplied to these data lines.

(2) In the foregoing embodiments, the image signals and the image data are corrected using the adder circuits 312 and 312-1 to 312-6. The determination as to whether to perform correction by addition or subtraction depends on the polarity of correction data or a correction signal. What is necessary is that a correction signal or correction data is included in advance in an image signal or image data so that a noise component can be canceled. Thus, the adder circuit may be a combining circuit that combines an image signal and a correction signal, or a combining circuit that combines image data and correction data.

(3) In the foregoing embodiments, the correction data is generated based on an image displayed on the screen S. However, the present invention is not limited to these embodiments. For example, input/output characteristics of the image processing circuits 300A and 300B can be measured, and correction data based on the measurement result can be generated.

(4) In the foregoing embodiments, the LCD panel 100 applied to the projector is described as an example of an electronic apparatus. Since a feature of the present invention is to correct image data or an image signal based on correction data that is generated in advance by a certain method, the present invention is not limited to the foregoing embodiments. Needless to say, the present invention is applicable to various other apparatuses using an electro-optical panel having an electro-optical material.

Figure 13:
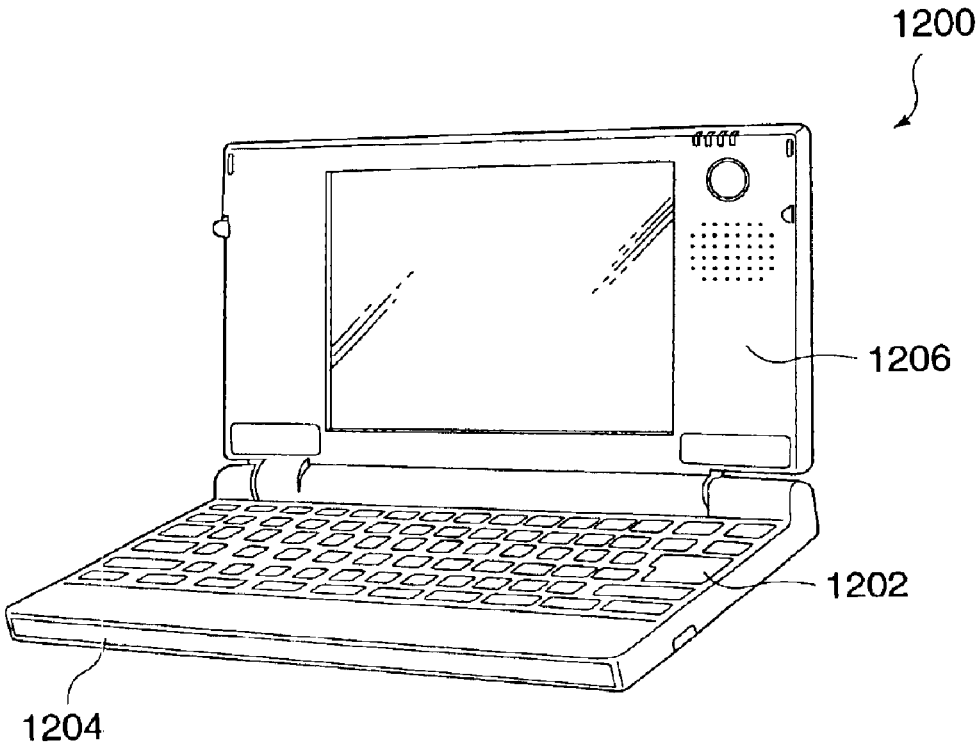
FIG. 13 is a perspective view showing the configuration of a personal computer, which is an example of an electronic apparatus to which the invention can be applied.

For example, the image processing circuits 300A and 300B and the LCD panel 100 can be applied to a mobile computer shown in FIG. 13. In FIG. 13, a computer 1200 includes a main unit 1204 with a keyboard 1202 and a liquid crystal display 1206. The liquid crystal display 1206 is formed by adding a backlight unit to the back of the foregoing LCD panel 100.

In addition to the electronic apparatus shown in FIG. 13, examples of electronic apparatuses include a liquid crystal television, a viewfinder-type or a monitor-direct-viewing-type video cassette recorder, a car navigation system, a pager, an electronic notebook, an electronic calculator, a word processor, a workstation, a cellular phone, a video phone, a POS terminal, and a device with a touch panel. Needless to say, the image processing circuits 300A and 300B and the LCD panel 100 are applicable to these and other various electronic apparatuses according to the present invention.

Although the present invention has been described through the example of an active matrix LCD using TFTs, the present invention is not limited to this case. The present invention is applicable to a device using a TFD (Thin Film Diode) as a switching element and to a passive LCD using STN liquid crystal. The present invention is not limited to LCDs. The present invention is applicable to display devices that perform display using various electro-optical effects, such as those using an electro-luminescence device.

Figure 14:
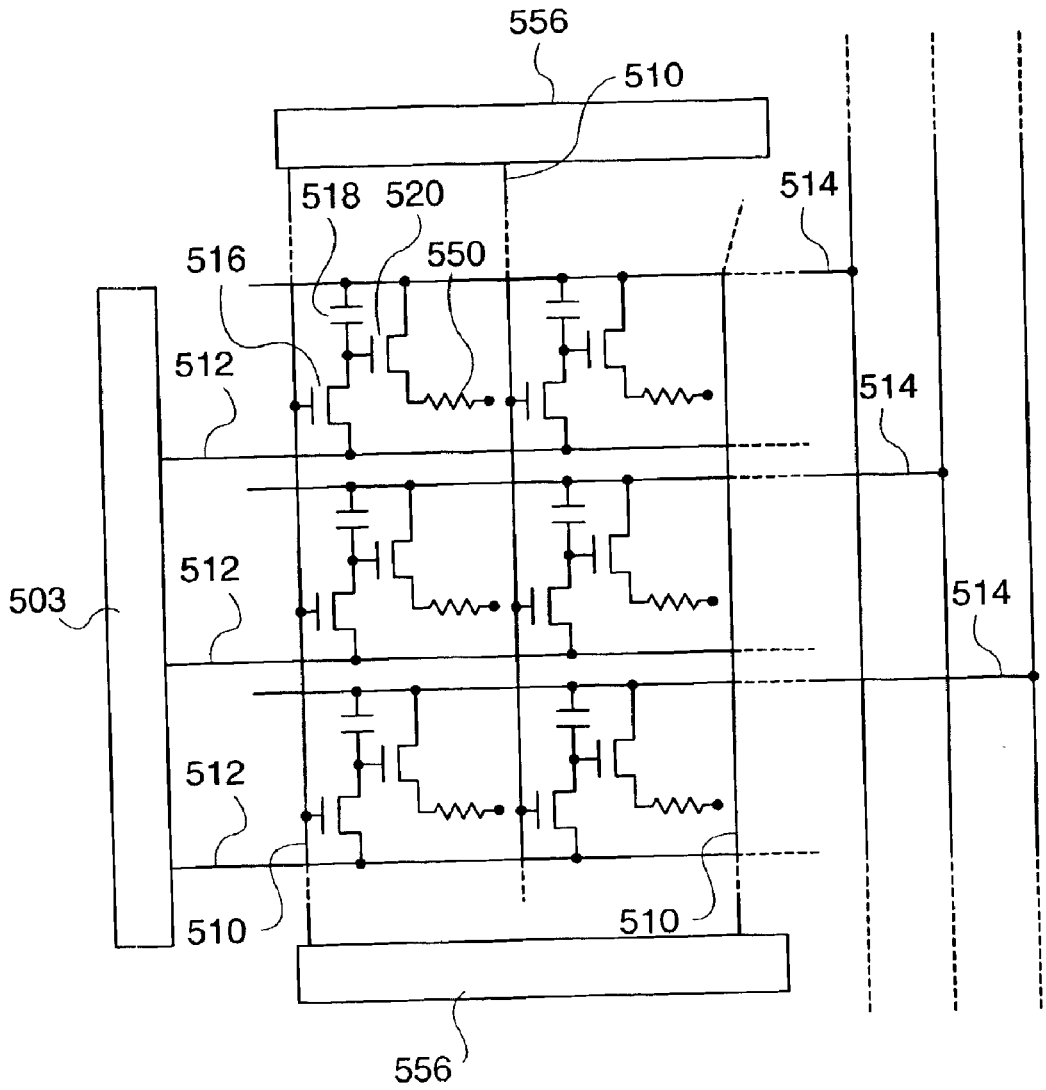
FIG. 14 is a schematic showing the basic circuit configuration of an organic electro-luminescence device.

FIG. 14 is a schematic showing the basic circuit configuration of an organic electro-luminescence device as an example of a case in which the electro luminescence device is used. A plurality of scanning lines 510, a plurality of data lines 512 extending in the direction orthogonal to the plurality of scanning lines 510, and a plurality of power lines 514 extending along the data lines 512 are formed on a substrate of a panel. At a location corresponding to each of the intersections of the scanning lines 510 and the data lines 512, an organic electro-luminescence device 550, a transistor 520 whose source or drain is connected to the organic electro-luminescence device 550, a transistor 516 whose gate is connected to the scanning line 510 and whose source or drain is connected to the data line 512, and a capacitative element 518 connected to the gate of the transistor 520.

The scanning lines 510 are electrically connected to a scanning-line driver 556 (including, for example, at least one of a shift register and a level shifter). The data lines 512 are electrically connected to a signal-line driver 503 (including, for example, at least one of a shift register, a D/A converter, a level shifter, a video line, a latch circuit, and a switch).

In accordance with the above apparatus, when a signal for turning ON the transistor 516 is supplied to the gate of the transistor 516 through the scanning line 510, the transistor 516 is turned ON. In response to this, when a data signal is supplied from the data line 512, electrical charges in accordance with the data signal are accumulated in the capacitative element 518. The conducting state of the transistor 520 is determined in accordance with the electrical charges accumulated in the capacitative element 518, thereby determining the amount of electrical current to be supplied to the organic electro-luminescence device 550. In accordance with the amount of electrical current, the organic electro-luminescence device 550 emits light.

According to an electro-optical device using such an electro-luminescence device, an input image signal can be subjected to phase expansion in each block on a plurality of channels can be displayed. As in the present invention, it is preferable that the input image signal be corrected prior to generating phase-expanded image signals. Alternatively, after phase-expanded image signals are generated, the phase-expanded image signals can be corrected. In the electro-optical device using the electro-luminescence device, an inverter circuit is necessary.

As described above, according to the present invention, an error generated in each channel in phase expansion can be corrected, and the quality of a displayed image can be greatly enhanced.

What is claimed is:

1. A method for driving an electro-optical device that includes a plurality of switching elements provided corresponding to intersections of a plurality of scanning lines and a plurality of data lines, and a plurality of pixel electrodes provided corresponding to the plurality of switching elements, the method comprising:

correcting an input image signal;

generating a corrected image signal;

splitting the corrected image signal into a plurality of channels;

expanding the time base of the split image signals, whereby phase-expanded image signals, which are phase-expanded into the plurality of channels, are generated;

sequentially selecting the scanning lines; and supplying, in a period during which each of the scanning lines is selected, the phase-expanded image signals corresponding to the data lines in each block, which include the plurality of data lines, in the step of generating the corrected image signal, the input image signal is corrected based on a correction signal generated based on an error in each channel, the error occurring when the phase-expanded image signals are generated.

2. A method for driving an electro-optical device that includes a plurality of switching elements provided corresponding to intersections of a plurality of scanning lines and a plurality of data lines, and a plurality of pixel electrodes provided corresponding to the plurality of switching elements, the method comprising:

splitting an input image signal into a plurality of channels;

expanding the time base of the split image signals, whereby phase-expanded image signals, which are phase-expanded into the plurality of channels, are generated;

correcting the phase-expanded image signals based on a correction signal generated based on an error in each channel, the error occurring when the phase-expanded image signals are generated;

sequentially selecting the scanning lines; and supplying, in a period during which each of the scanning lines is selected, corrected phase-expanded image signals to the corresponding data lines in each block, which include the plurality of data lines.

3. An image processing circuit used in an electro-optical device which includes a plurality of switching elements provided corresponding to intersections of a plurality of scanning lines and a plurality of data lines, and a plurality of pixel electrodes provided corresponding to the plurality of switching elements, the electro-optical device sequentially selecting the scanning lines and applying phase-expanded image signals in each block, which include the plurality of data lines, in a period during which each of the scanning lines is selected, the image processing circuit comprising:

a correction device that generates, in synchronization with a period in which the block is selected, correction signals to correct an error synchronized with the period in which the block is selected, and to correct an input image signal based on the correction signals, whereby a corrected image signal is generated; and a generation device that splits the corrected image signal into a plurality of channels and that expands the time base of the split image signals, whereby the phase-expanded image signals, which are phase-expanded into the plurality of channels, are generated.

4. The image processing circuit according to claim 3, the correction device including:

a latch circuit group that latches the correction signals in the period in which the block is selected;

a selection circuit that sequentially selects output signals of the latch circuit group; and a combining circuit that combines an output signal of the selection circuit with the input image signal, whereby the corrected image signal is generated.

5. The image processing circuit according to claim 3, the correction device selecting the correction signals in accordance with a direction in which the data lines are selected, and generating the corrected image signal based on the selected correction signal and the input image signal.

6. The image processing circuit according to claim 5, the correction device including:

a latch circuit group that latches the correction signals in the period in which the block is selected;

a selection circuit that sequentially selects output signals of the latch circuit group based on a control signal indicating the direction in which the data lines are selected; and a combining circuit that combines an output signal of the selection circuit with the input image signal, whereby the corrected image signal is generated.

7. An electronic apparatus, comprising:

the image processing circuit as set forth in claim 3;

a scanning-line driving device that sequentially selects the scanning lines; and a block driving device that sequentially selects, in a period during which each of the scanning lines is selected, blocks, each including a plurality of data lines, whereby the phase-expanded image signals are supplied to the corresponding data lines belonging to the selected block.

8. An image processing circuit used in an electro-optical device which includes switching elements provided corresponding to intersections of a plurality of scanning lines and a plurality of data lines, and a plurality of pixel electrodes provided corresponding to the plurality of switching elements, the electro-optical device sequentially selecting the scanning lines and applying phase-expanded image signals in each block, which include the plurality of data lines, in a period during which each of the scanning lines is selected, the image processing circuit comprising:

a phase expansion device that phase-expands an input image signal into image signals on a plurality of channels; and a correction device that generates, in synchronization with a period in which the block is selected, each correction signal to correct an error synchronized with the period in which the block is selected, and to correct each of the image signals, whereby the phase-expanded image signals are generated.

9. The image processing circuit according to claim 8, the correction device including:

a latch circuit group that latches the correction signals in the period in which the block is selected; and a plurality of combining circuits that combine each output signal of the latch circuit group with each of the image signals, whereby the phase-expanded image signals are generated.

10. The image processing circuit according to claim 8, the correction device selecting the correction signals in accordance with a direction in which the data lines are selected, and generating the phase-expanded image signals based on the selected correction signal and each of the image signals.

11. The image processing circuit according to claim 8, the correction device including:

a latch circuit group that latches the correction signals in the period in which the block is selected;

a plurality of combining circuits that combine output signals of the latch circuit group with each of the image signals, whereby the phase-expanded image signals are generated; and a supplying circuit that supplies the output signals of the latch circuit group to the plurality of combining circuits based on a control signal indicating a direction in which the data lines are selected.

12. An electronic apparatus, comprising:

the image processing circuit as set forth in claim 8;

a scanning-line driving device that sequentially selects the scanning lines; and a block driving device that sequentially selects blocks, each including a plurality of data lines, in a period during which each of the scanning lines is selected, and that supplies the phase-expanded image signals to the corresponding data lines belonging to the selected block.

* * * * *